US008291917B2

(12) United States Patent
Sweeney

(10) Patent No.: US 8,291,917 B2
(45) Date of Patent: Oct. 23, 2012

(54) ATTACHABLE LIGHTER TOOL

(76) Inventor: Andrew Sweeney, Portland, OR (US)

( * ) Notice: Subject to any disclaimer, the term of this patent is extended or adjusted under 35 U.S.C. 154(b) by 486 days.

(21) Appl. No.: 12/554,893

(22) Filed: Sep. 5, 2009

(65) Prior Publication Data

US 2010/0065073 A1 Mar. 18, 2010

Related U.S. Application Data

(60) Provisional application No. 61/097,136, filed on Sep. 15, 2008.

(51) Int. Cl.
*A24F 3/02* (2006.01)

(52) U.S. Cl. ..... 131/243

(58) Field of Classification Search ..... None
See application file for complete search history.

(56) References Cited

U.S. PATENT DOCUMENTS

| | | | | |
|---|---|---|---|---|
| 400,966 | A | | 4/1889 | Strachan |
| 544,691 | A | | 8/1895 | Rupprecht |
| 610,142 | A | | 8/1898 | LeBron |
| 827,558 | A | | 7/1906 | Niell |
| 865,547 | A | | 9/1907 | Walker |
| 936,678 | A | | 10/1909 | Sommer |
| 1,063,066 | A | | 5/1913 | Robinson |
| 1,526,938 | A | | 2/1925 | Sommerfeldt |
| 1,594,311 | A | | 7/1926 | Ludasy |
| 1,602,607 | A | | 10/1926 | Douglass |
| 1,757,607 | A | | 5/1930 | Zullo |
| 2,003,416 | A | * | 6/1935 | Anderson ..... 7/118 |
| 2,081,976 | A | | 6/1937 | Anderson |
| 2,444,663 | A | | 7/1948 | Miller |
| 2,536,852 | A | | 1/1951 | Middleton |
| 2,539,249 | A | | 1/1951 | Holland |
| 2,719,526 | A | | 12/1951 | Bachman |
| 2,585,071 | A | | 2/1952 | Allen |
| 2,633,137 | A | | 3/1953 | Narragon |
| 2,818,715 | A | | 1/1958 | Polack |
| 2,828,855 | A | | 4/1958 | Mosch |
| 2,894,515 | A | | 7/1959 | Wismer |
| 3,200,822 | A | | 8/1965 | Meyer |
| 3,220,420 | A | | 11/1965 | Genoud |
| 3,263,690 | A | | 8/1966 | Buckley |
| 3,269,396 | A | | 8/1966 | Lamar |
| 3,746,013 | A | | 7/1973 | Larson |
| 3,777,766 | A | | 12/1973 | Kanady |
| 4,043,348 | A | | 8/1977 | Kanady |
| 4,152,109 | A | | 5/1979 | Schaffer |
| 4,318,416 | A | | 3/1982 | Thornhill |
| 4,363,432 | A | * | 12/1982 | Warthen ..... 224/247 |
| 4,600,022 | A | | 7/1986 | Pierce |
| D372,333 | S | * | 7/1996 | Pearson ..... D27/144 |
| 5,722,430 | A | | 3/1998 | Bentley et al. |
| 2008/0142026 | A1 | | 6/2008 | Chou |

* cited by examiner

*Primary Examiner* — Michael J Felton
(74) *Attorney, Agent, or Firm* — Gerard Carlson

(57) ABSTRACT

An attachable lighter tool has a clip slideably engaging the body of the lighter. The clip slides along the major axis of the lighter. An implement such as a poker or tamper extends from the clip along the major axis of the lighter. When not in use, the tool conforms substantially against the body of the lighter and is out of the way. In use, a smoker slides the clip along the major axis of the lighter exposing the implement for the servicing of the smoker's pipe.

16 Claims, 9 Drawing Sheets

ATTACHABLE LIGHTER TOOL

CROSS REFERENCE TO RELATED APPLICATIONS

This application claims the benefit of the provisional application entitled "Attachable Pipe Tool for Lighters" by Andrew Sweeney, Ser. No. 61/097,136 filed Sep. 15, 2008, and is hereby incorporated by reference in its entirety.

FEDERALLY SPONSORED RESEARCH OR DEVELOPMENT

Not applicable.

JOINT RESEARCH AGREEMENT

Not applicable

SEQUENCE LISTING

Not applicable

FIELD OF THE INVENTION

The present invention relates to the field of pipe, cigarette and cigar lighters and in particular to tools for the cleaning, service and use of smokers' pipes.

BACKGROUND OF THE INVENTION

Smokers' pipes generally tend to clog with residue and ashes during use. Pipe smokers routinely encounter the problem of clogged or dirty pipes which adversely affect the enjoyment of smoking. Currently smokers of pipes use tools to clean and maintain their pipes. Pipe tools are known by a variety of names. One tool is commonly called a poker and is used to clean the bowl or stem of the pipe. Another tool is called a tamper and is used to compress the tobacco in the pipe bowl.

Often these tools are separate from the pipe or lighter. Other times the tools are built into the lighter for ready access.

SUMMARY OF THE INVENTION

In one embodiment, an attachable lighter tool (also referred to as simply "the tool"), has a clip slideably engaging the body of the lighter. The clip slides along the major axis of the lighter. An implement such as a poker or tamper extends from the clip along the major axis of the lighter. When not in use, the tool conforms substantially against the body of the lighter and is out of the way. In use, the smoker slides the clip along the major axis of the lighter exposing the implement for the servicing of the pipe.

In another embodiment the tool comprises a clip that has two opposing sides which meet at a gap, the opposing sides are adapted to fit slidingly about the body of the lighter. The opposing sides are further urged against the body of the lighter by a spring force. An implement extends from the clip substantially parallel to the longitudinal axis of the lighter. The spring force between the sides of the clip can be provided by the material of the clip itself or the springiness of the lighter body. In other embodiments, the smoker may compress the two opposing sides to increase the frictional force between the tool and the lighter. Still other embodiments can treat the opposing sides to increase the friction at the interface between the sides and the lighter.

In other embodiments the tool has a clip adapted to fit graspingly about the body of a lighter. The clip further has an implement portion substantially parallel to the longitudinal axis of the lighter. The clip further is adapted to slide longitudinally along the body of the lighter, stowing the implement substantially against the body of the lighter in a first position and exposing the implement beyond the body of the lighter in a second position. In the second position the implement is exposed for the servicing of a smoker's pipe. In some embodiments the tool can be made of a single piece of material with the implement rigidly attached to the clip. Example implements are a poker and a tamper. The surfaces and edges of the implement can be treated to act as a file, knife edge or point to aid in the servicing of a smoker's pipe.

In further embodiments the tool employs the body of the lighter to act as a handle for the implement. By extending the tool along the body of the lighter, the user can grasp the tool and lighter together as one. This enables a more comfortable fit to the user's hand and provides more leverage at the implement end of the tool during the servicing of the pipe.

In yet further embodiments the tool has any number of markings or logos upon it for use in brand recognition, product or service advertising. The markings can be any number of methods including silk screening, painted, milling, printing, etching or stenciling.

In yet another embodiment of the tool, the tamper is adapted to receive a poker. The poker is adapted to slide beyond the end of the tamper. This allows both a tamper and a poker to be available on the same lighter.

BRIEF DESCRIPTION OF DRAWINGS

The summary above and the following detailed description will be better understood in view of the enclosed drawings which depict details of preferred embodiments. Like reference numbers designate like elements. It should however be noted that the invention is not limited to the precise arrangement shown in the drawings. The features, functions and advantages can be achieved independently in various embodiments of the claimed invention or may be combined in yet other embodiments.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modification to the various disclosed embodiments may be made and other embodiments may be utilized, without departing from the spirit and scope of the present invention. The following detailed description is therefore, not to be taken in a limiting sense.

Figure 1:
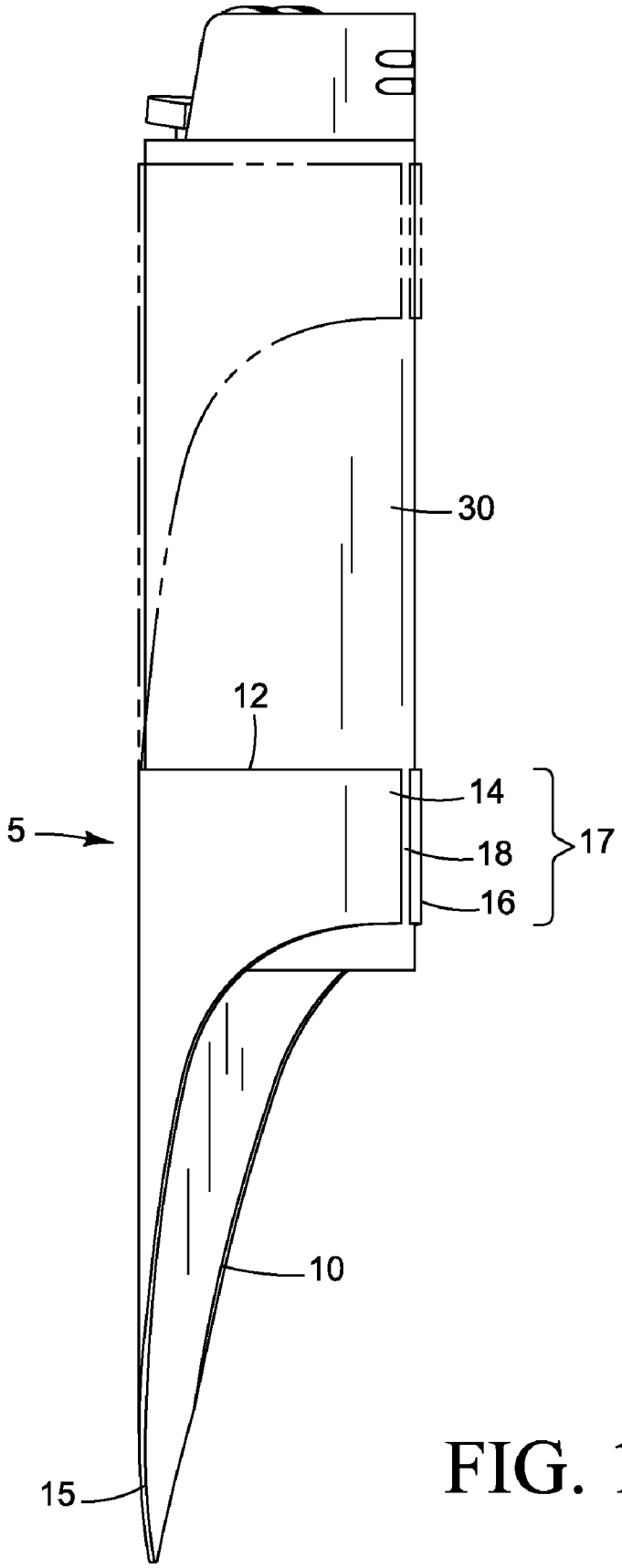
FIG. 1 shows one embodiment of the tool in the extended position, attached to a lighter.

FIG. 1 shows one embodiment of the tool 5. The tool 5 is of a shape adapted to fit over the body of a lighter 30. Two sides, 14 and 16 meet at a gap 18 to form a clip 17. The tool 5 is characterized by an open end 12 and an implement end 10. The implement end 10 is also referred to as a tool end. In the embodiment of FIG. 1, the implement end 10 has an implement type called a poker 15. Other implement types are possible.

The tool 5 can be made of a number of materials. In one embodiment, the tool 5 is made of steel. Other materials such as glass, plastic, wood and other metals are possible. In some embodiments the two sides 14 and 16 forming the clip 17, are slightly smaller than the lighter 30 so that together with the springiness of the material, the tool 5 fits snuggly over the body of the lighter 30. The gap 18 widens as the lighter 30 slides between the tool sides 14 and 16. By pressing against the body of the lighter 30, the two opposing sides 14 and 16 form a clip 17 that slideably engages the body of the lighter 30.

The tool 5 is slideable along the major or longitudinal axis of the lighter 30. The poker 15, rigidly fixed to the clip 17, extends from the clip 17 along the major axis of the lighter. Dashed lines show the tool 5 positioned against the body of the lighter 30 in a first position. This first position is a stowed position where the tool 5 is out of the way when not in use. Solid lines show the tool 5 in a second position extended from the body of the lighter 30 ready for use. In preparation for use, the smoker slides the tool 5 from the first stowed position to the second position exposing the implement, in this example the poker 15. After use, the smoker slides the tool 5 back to the stowed position effectively shielding the poker 15 or other implement type against the body of the lighter 30.

In summary a clip 17 is adapted to fit graspingly about the body of a lighter 30. The clip 17 further has an implement portion, in this embodiment a poker 15 substantially parallel to the longitudinal axis of the lighter 30. The clip 17 is further adapted to slide longitudinally along the body of the lighter 30, stowing the poker 15 substantially against the body of the lighter in a first position and exposing the poker 15 or other implement type beyond the body of the lighter 30 in a second position.

Figure 2:
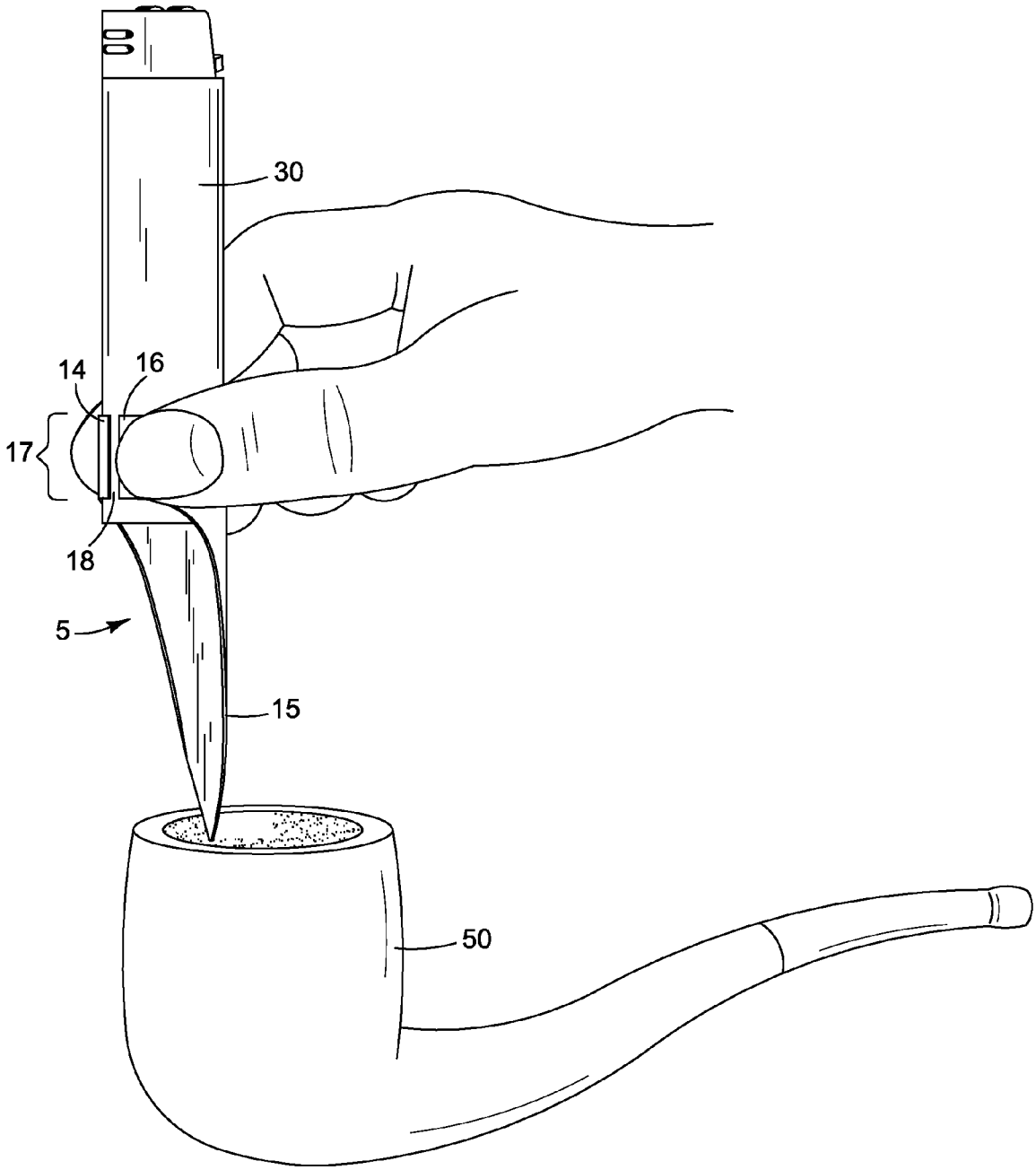
FIG. 2 shows one embodiment of the tool servicing the bowl of a smoker's pipe.

FIG. 2 shows one embodiment of the tool 5 adapted to service the bowl of a smoker's pipe 50. The implement in this embodiment is a poker 15. Pokers are suitable for scraping residue from the bowls of pipes 50 or cleaning out the pipe stems. The clip 17 formed by opposing sides 14 and 16 meeting at a gap 18 grasps the body of the lighter 30. There are several ways to accomplish this grasping action. One way is to have the material of the tool 5 springy so that the opposing sides 14 and 16 tend to close the gap 18. When the lighter 30 is inserted into the clip 17 the sides 14 and 16 are forced outward and exert an inward force against the body of the lighter 30. In other embodiments, the opposing sides 14 and 16 can be more rigid and can rely more on the compressibility of the body of the lighter 30. In this case, the force is produced in part by the outward force of the body of the lighter 30 pressing against the sides 14 and 16. In other embodiments, the inner surface of the sides 14 and 16 can be treated to modify the coefficient of friction between the body of the lighter 30 and the sides 14 and 16. This surface treatment can include, but is not limited to, painting, plating or texturing. In still other embodiments the opposing sides 14 and 16 are compressible to increase the frictional force between the opposing sides and the body of the lighter 30. The user can compress the sides 14 and 16 against the body of the lighter 30 with thumb and forefinger as shown in FIG. 2. This method allows the tool 5 to easily slide against the body of the lighter 30 but be held more rigidly during use. These various methods can be used singly or in combination.

In the extended position, the body of the lighter 30 serves as a handle when the tool 5 is in the second position. By grasping the lighter 30 and tool 5 together the user has more leverage for applying the poker 15 or other implement against the bowl or other parts of the pipe 50. This is advantageous in that the tool 5 can be constructed with less material and rely upon the body of the lighter 30 to serve as a handle.

Figure 3:
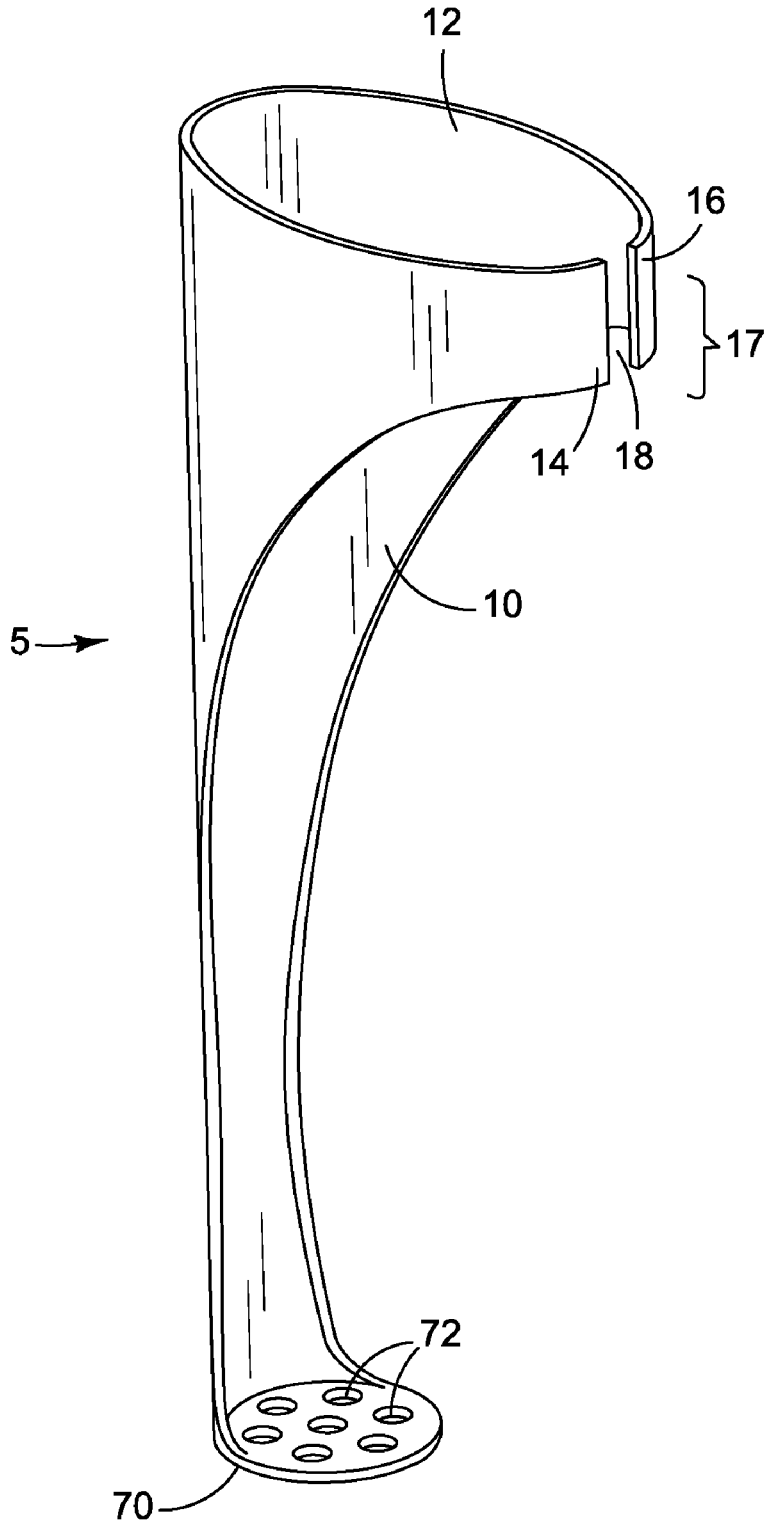
FIG. 3 shows one embodiment of tool where the implement is a tamper.

FIG. 3 shows one embodiment of tool where the implement is a tamper 70. Similar to the embodiment of FIG. 1, this embodiment has a clip 17 having two opposing sides 14 and 16 meeting at a gap 18. The opposing sides are adapted to fit slidingly about the body of the lighter (not shown). The opposing sides are further adapted to press or urge against the body of the lighter (not shown) by a spring force. A tamper 70 extends from the clip 17 substantially parallel to the longitudinal axis of the lighter (not shown). The tamper 70 is adapted to compress the contents in a pipe bowl while allowing air to reach the contents. The tamper 70 has one or more openings 72 to allow air to reach the burning tobacco while it is being compressed in the bowl of a pipe. While the openings 72 are depicted as holes in FIG. 3, other openings such as slots or a tamper in the form of a star pattern are also possible.

Figure 4:
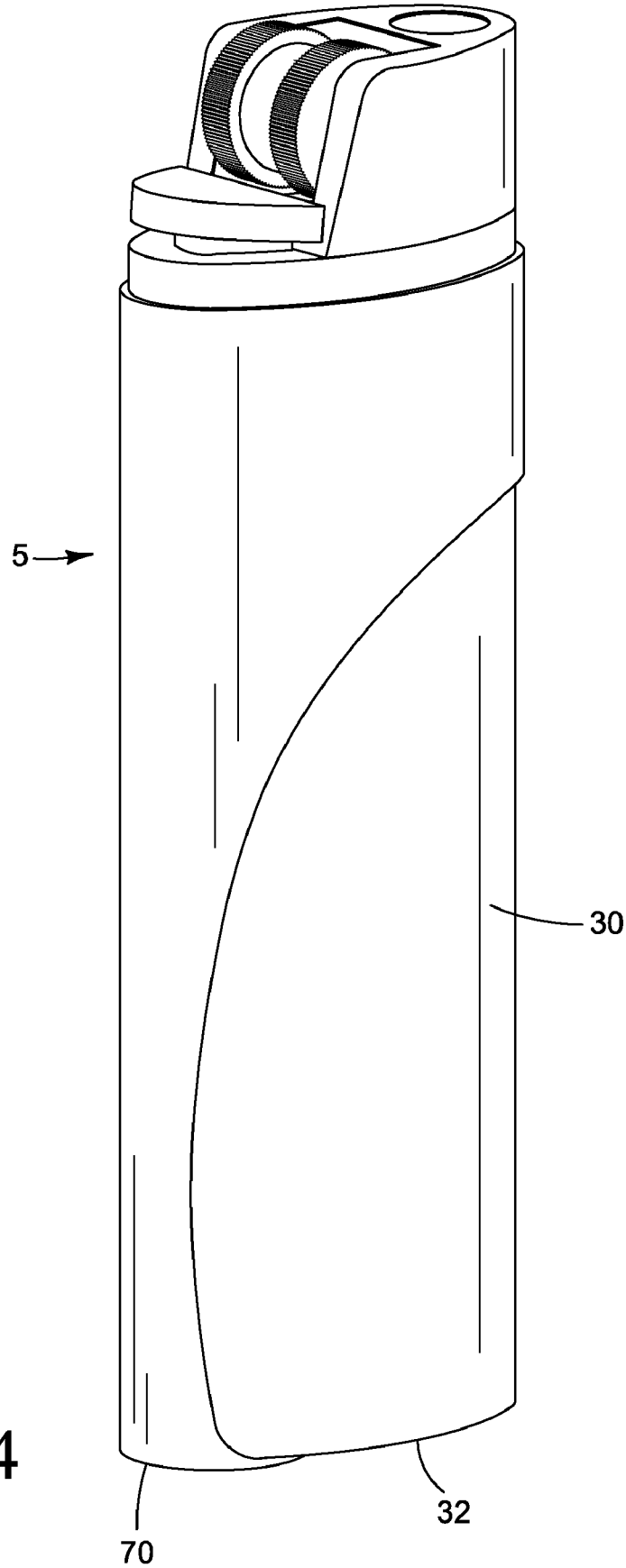
FIG. 4 shows one embodiment of the tool conforming to the body of a lighter.

FIG. 4 shows one embodiment of the tool 5 conforming to the body of a lighter 30. In this embodiment a tamper 70 is in a stowed position. The bottom of the tamper 70 fits snuggly against the butt-end or bottom 32 of the lighter 30. In this stowed position not only is the tamper 70 stored compactly, but the user is more protected from sharp edges associated with the tamper 70 or other implements.

Figure 5:
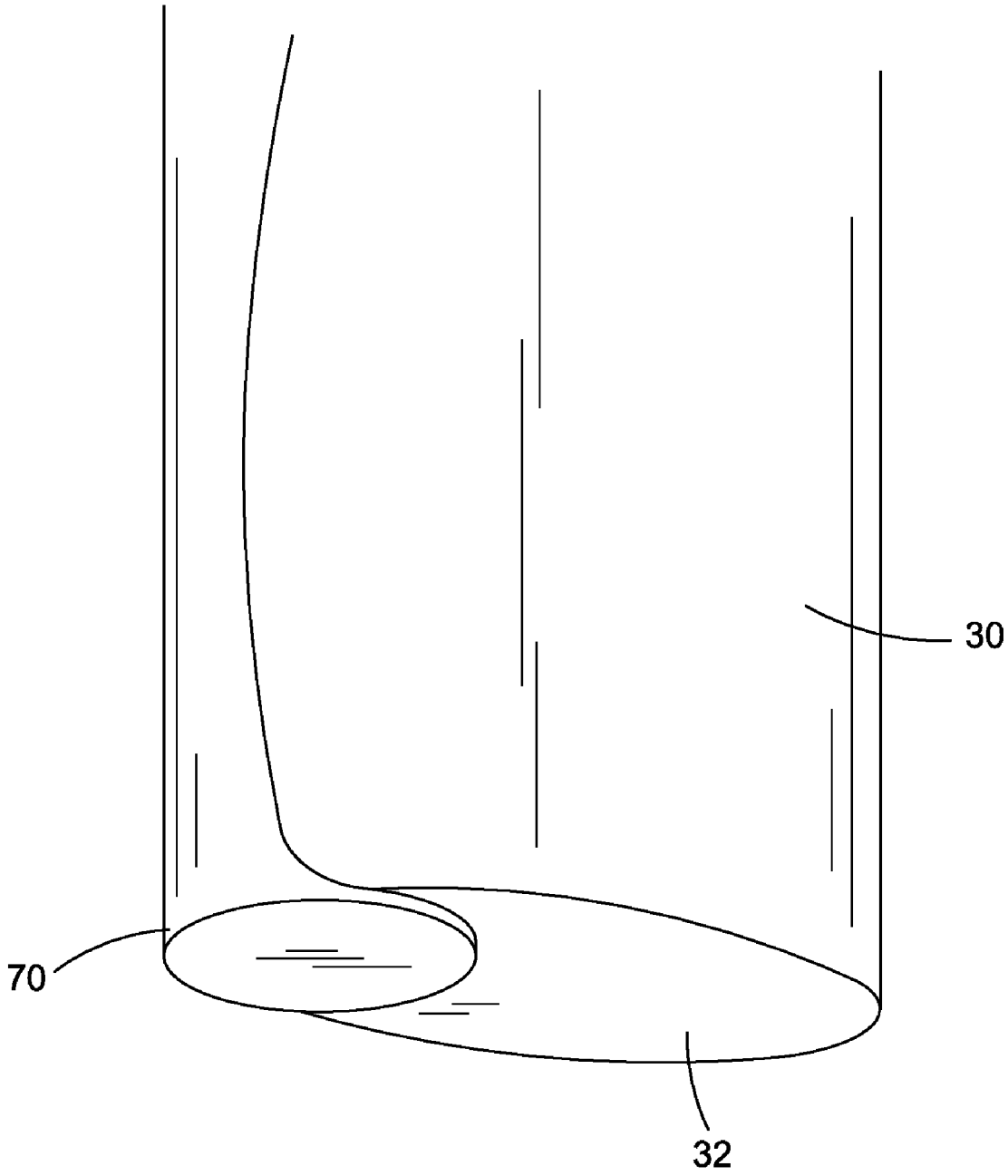
FIG. 5 shows a close up of a tamper embodiment against the body of a lighter.

FIG. 5 shows a close up of a tamper embodiment 70 against the bottom 32 of the body of a lighter 30.

Figure 6:
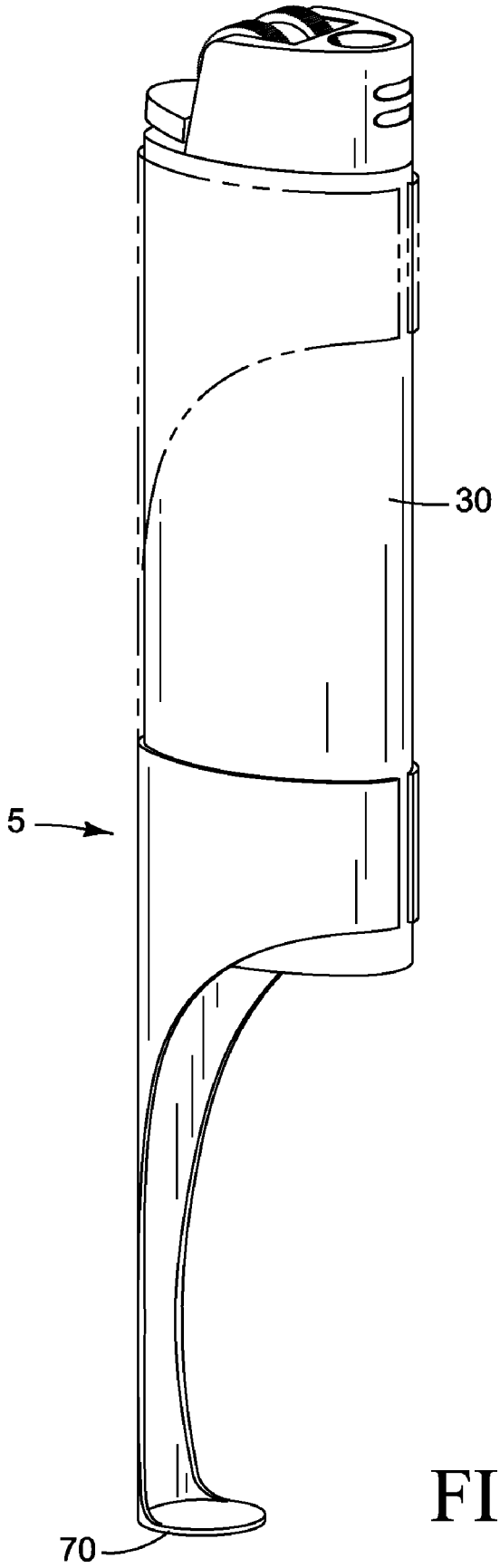
FIG. 6 shows a tamper embodiment of the tool in an extended position from the body of a lighter.

FIG. 6 shows a tamper embodiment 70 of the tool 5 in an extended position from the body of a lighter 30. The dashed lines illustrate a first or stowed position where the tamper 70 is not in use. The solid lines show the tamper 70 in a second or extended position where it is slid down along the major or longitudinal axis of the lighter 30. In this position the tamper 70 is available to the user to compress the contents of the pipe bowl.

Figure 7:
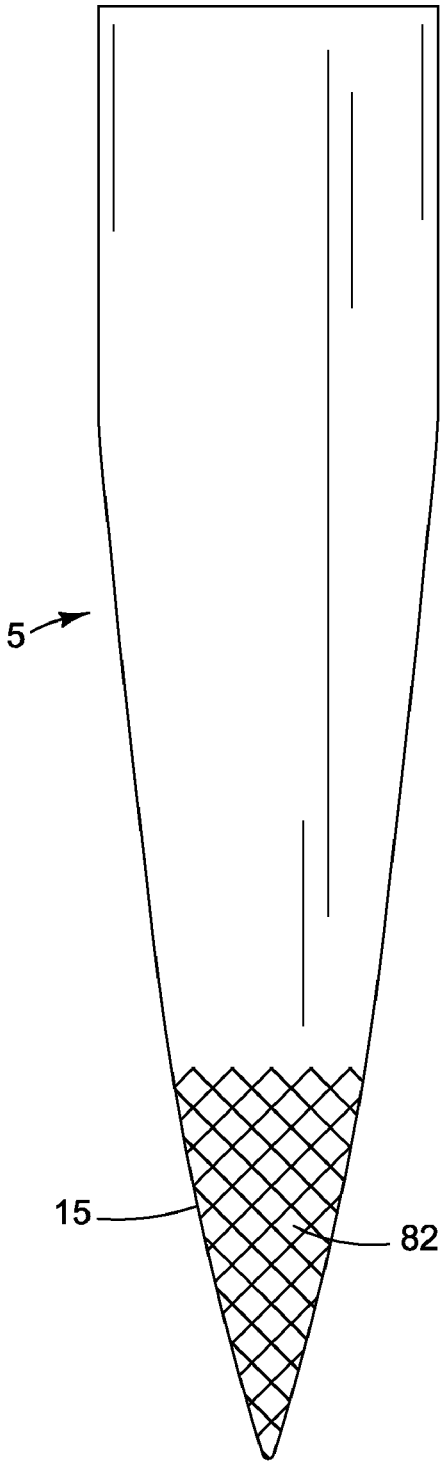
FIG. 7 shows an embodiment of the tool with a poker implement usable as a file.

FIG. 7 shows an embodiment of the tool with a poker 15 usable as a file 82. In FIG. 7 the lower portion of the implement, in this case a poker 15 has the surface treated or textured to act as a file 82. This surface treatment can be accomplished in a number of ways including, but not limited to, etching, milling, stamping, molding, and rolling. The many methods used to incorporate the file surface are well known to those skilled in the art of material fabrication.

Figure 8:
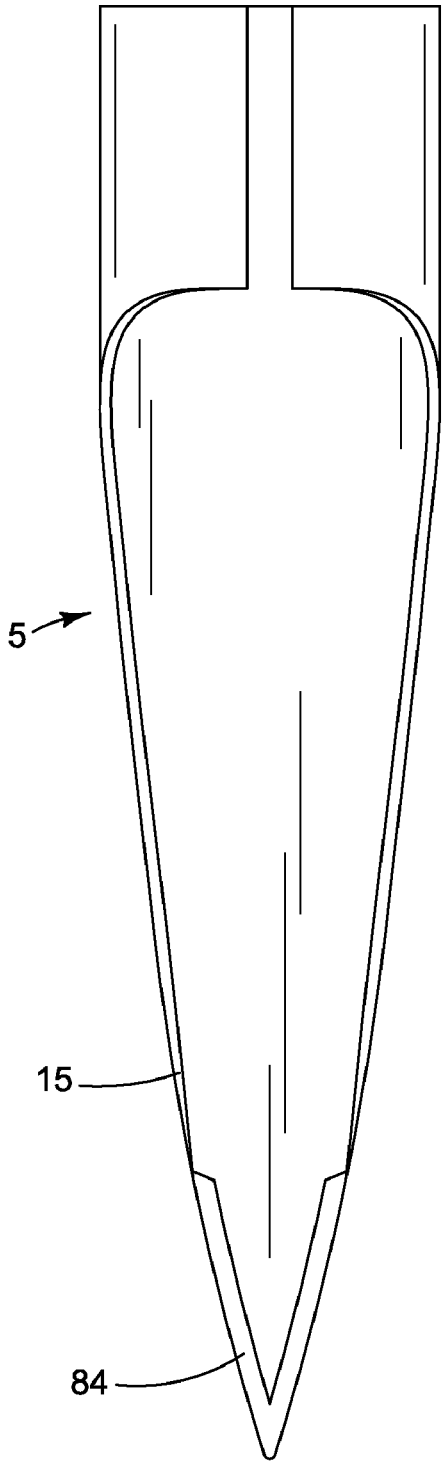
FIG. 8 shows a one embodiment of the tool with a poker implement treated to have a sharpened edge.

FIG. 8 shows a one embodiment of the tool 5 with a poker 15 treated to have a sharpened edge 84. The sharpened edge can take on a number of forms including but not limited to straight or serrated. Edges or edge treatments can be provided for specific designs and shapes of pipe bowls. It is possible for example to have different radiuses on different edges of the poker 15 to accommodate different types of pipes. Such edges and treatments are also applicable to the tamper 70 of FIGS. 3 through 6.

Figure 9:
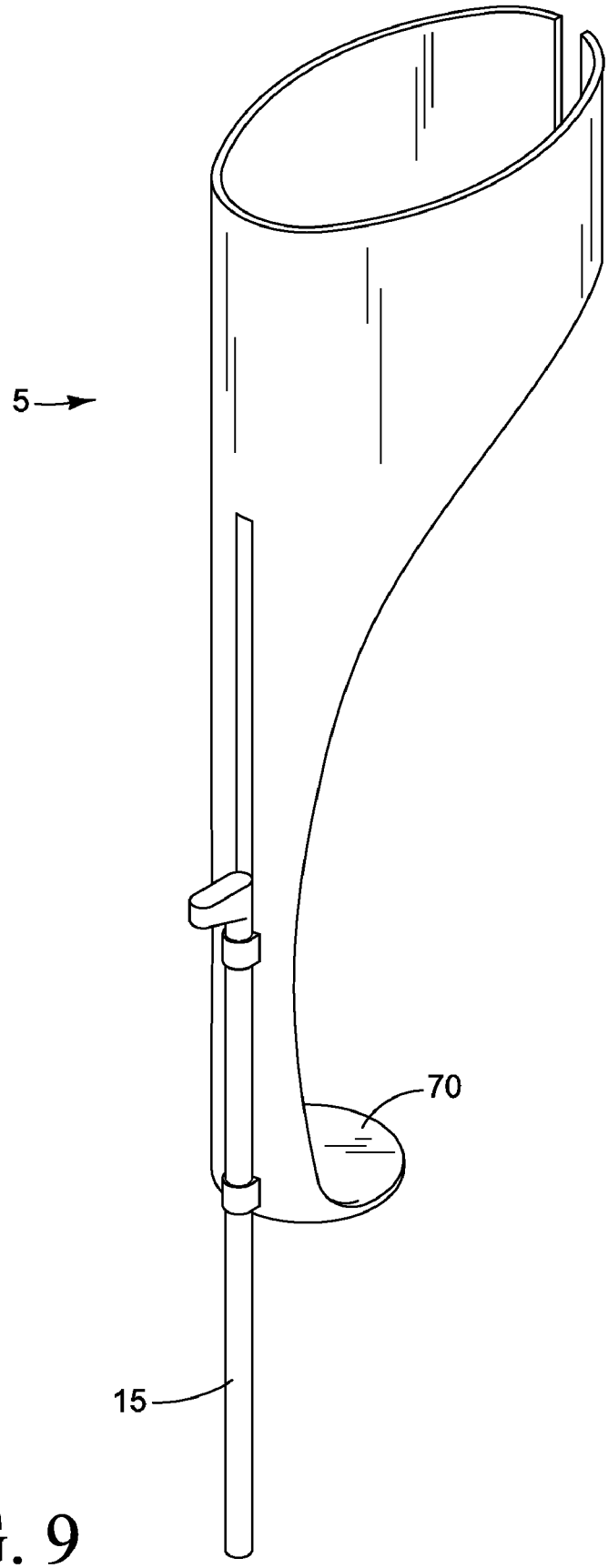
FIG. 9 shows one embodiment of the tool with a combination of tamper and poker implements.

FIG. 9 shows one embodiment of the tool 5 with a combination of tamper 70 and poker 15. The tool 5 has tamper 70 which is adapted to receive a poker 15. The poker 15 is adapted to slide beyond the end of the tamper 70. This embodiment allows the user to carry both a poker 15 and tamper 70 on one lighter. The poker in FIG. 9 is depicted as a rod but other poker types such as the blade of FIG. 1 are also possible. When not in use both the poker 15 and tamper 70 are retracted against the lighter body as shown in FIG. 4. In use the poker 15 can be extended from the lighter body and tamper 70 to service the pipe. The poker 15 can be retracted into the tamper 70 and the tamper 70 extended from the body of the lighter as shown in FIG. 6 for tamping of pipe bowl contents.

Figure 10:
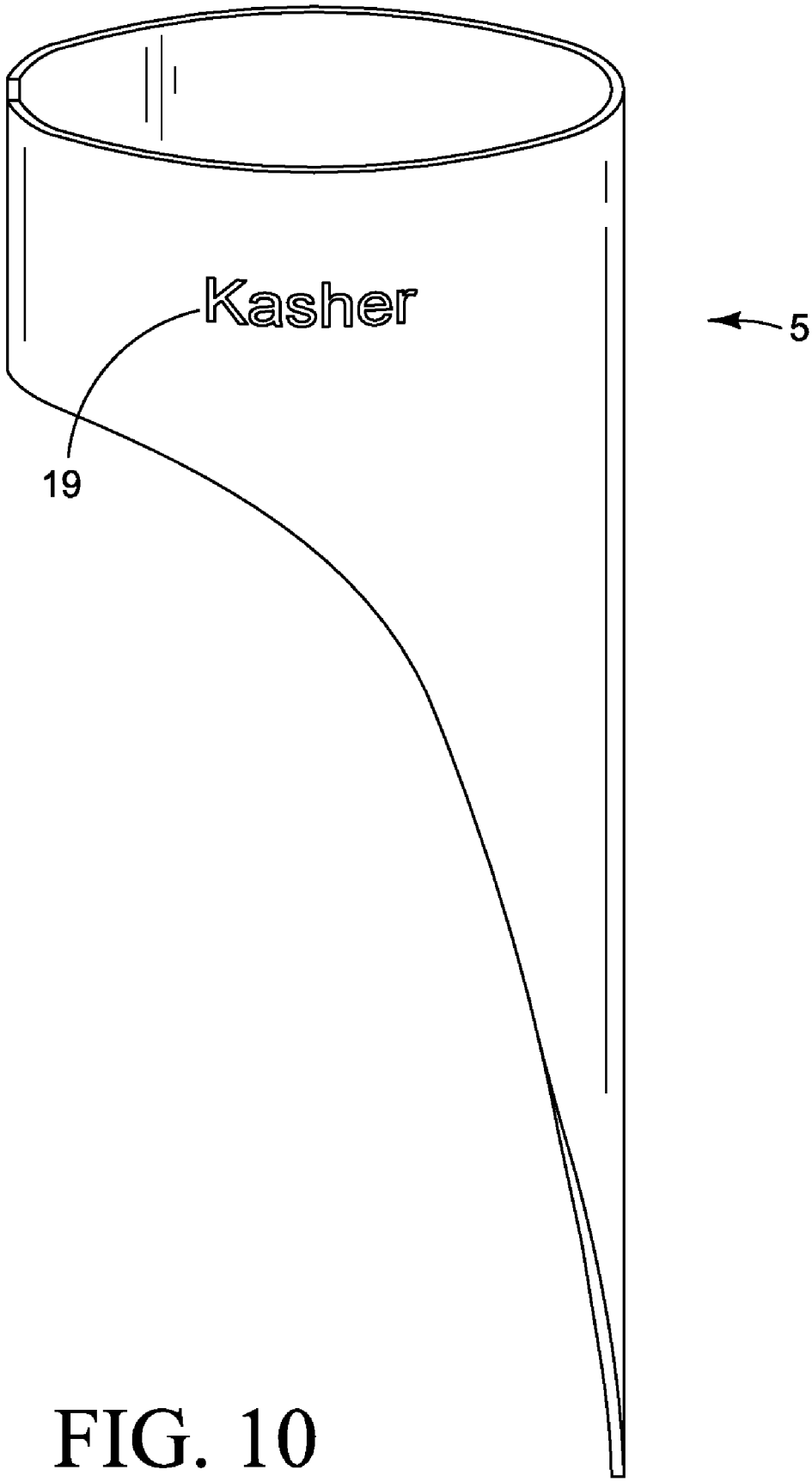
FIG. 10 shows an embodiment of the tool with a design.

FIG. 10 shows an embodiment of the tool 5 with a design 19. The design 19, can take a number of different forms. As shown in FIG. 10, the design 19 is stenciled through the material of the tool 5. Many ways exist to incorporate the design into the tool 5. These include, but are not limited to, etching, milling, silk screening, stamping, molding, and painting. The many methods used to incorporate the design are well known to those skilled in the art of material fabrication. The design 19 can be built into the tool 5 during manufacture or added as a follow-on step. Each approach has its advantages. In the case of large volume manufacture, the design 19 is build into the initial manufacturing process to reduce follow-on steps and reduce overall costs. In the case of smaller production lots, a large number of tools 5 are built without the design 19, and then the design 19 is added to the tools 5. This allows limited runs of custom designs 19 added to a large production run of tools 5 built without designs.

The design 19 can be modified to advertise particular brands of tobacco, commemorate an event, promote a tobacco or pipe distributor or many other things.

Especially noteworthy is that the tool 5 can be shipped independently of the lighter (not shown). This is useful given the aircraft and shipping restrictions on compressed fluids and flammable materials. In one example a promoter of a smoke shop can order the attachable pipe tool 5 with his particular logo as the design 19. The design is added to a batch of mass-produced tools 5 thus customizing them. The completed tools 5 with the design 19 can be air shipped without any hazardous material restrictions from the factory to the pipe shop. The pipe shop owner then assembles the tools 5 to readily available lighters.

In another example, a promoter can switch the type of tool 5 he puts on the lighter. In this scenario the tool is not tied to the lighter. If one type of tool or design proves more popular, the lighters with the less popular design can be switched to the preferred tool.

In still another example, a traveler can keep his tool with him on a plane trip while leaving his lighter at home. Because lighters are restricted from many flights, a pipe smoker can buy an inexpensive lighter at his destination and attach the tool 5 upon arrival.

In yet another example, a tool with a custom design, color or logo can help a user keep track of his lighter. Many smokers lose track of their lighters. A distinctive tool helps identify the lighter to the user.

Because the tool is easily attachable and removable from the lighter, the tool is not lost when a disposable lighter is discarded. The tool is quickly transferred to the new lighter. This is especially useful as fewer people refill lighters and more people dispose of them rather than refill them.

Although this invention has been described in terms of certain preferred embodiments, other embodiments that are apparent to those of ordinary skill in the art, including embodiments that do not provide all of the features and advantages set forth herein, are also within the scope of this invention. Rather, the scope of the present invention is defined only by reference to the appended claims and equivalents thereof.

What is claimed is:

1. An attachable lighter tool comprising:

a clip adapted to slideably engage the body of a lighter, the clip slideable along the major axis of the lighter;

an implement extending from the clip along the major axis of the lighter, the implement having at least one sharpened edge; and the clip and implement being a single piece of material.

2. The tool of claim 1 wherein the implement is a poker.

3. The tool of claim 1 wherein the implement is a tamper.

4. The tool of claim 2 wherein the poker is adapted to service the bowl of a smoker's pipe.

5. The tool of claim 3 wherein the tamper is adapted to compress the contents in a pipe bowl while allowing air to reach the contents.

6. An attachable lighter tool comprising:

a clip having two opposing sides meeting at a gap, the opposing sides adapted to fit slidingly about the body of a lighter, the opposing sides further urged against the body of the lighter by a spring force;

an implement extending from the clip substantially parallel to the longitudinal axis of the lighter, the implement having at least one sharpened edge; and the clip and implement being a single piece of material.

7. The tool of claim 6 wherein the spring force is provided by the opposing sides pressing against the body of the lighter.

8. The tool of claim 6 wherein the spring force is provided by the body of the lighter pressing against the opposing sides.

9. The tool of claim 6 wherein the opposing sides are treated to increase the coefficient of friction between the opposing sides and the body of the lighter.

10. The tool of claim 6 wherein the opposing sides are compressible to increase the frictional force between the opposing sides and the body of the lighter.

11. An attachable lighter tool comprising:

a clip adapted to fit graspingly about the body of a lighter, the clip further having an implement portion substantially parallel to the longitudinal axis of the lighter, the clip further adapted to slide longitudinally along the body of the lighter, stowing the implement substantially against the body of the lighter in a first position, exposing the implement beyond the body of the lighter in a second position, the implement having at least one sharpened edge; and the clip and implement being a single piece of material.

12. The tool of claim 11 wherein the implement is a poker.

13. The tool of claim 11 wherein the implement is a tamper.

14. The tool of claim 11 wherein the implement is textured to act as a file.

15. The tool of claim 11 wherein the body of the lighter serves as a handle when the tool is in the second position.

16. The tool of claim 3 wherein the tamper further includes openings allowing air to reach contents in a pipe bowl while the contents are being compressed by the tamper.

* * * * *